US006938559B2

(12) United States Patent
Wullenweber

(10) Patent No.: US 6,938,559 B2
(45) Date of Patent: Sep. 6, 2005

(54) METAL AND PLASTIC PALLET ASSEMBLY

(76) Inventor: Kurt Wullenweber, 9216 Hayden Rd., Jacksonville, FL (US) 32207

( * ) Notice: Subject to any disclaimer, the term of this patent is extended or adjusted under 35 U.S.C. 154(b) by 21 days.

(21) Appl. No.: 10/666,906

(22) Filed: Sep. 19, 2003

(65) Prior Publication Data

US 2005/0061210 A1 Mar. 24, 2005

(51) Int. Cl.[7] ..... B65D 19/00
(52) U.S. Cl. ..... 108/57.25; 108/51.11
(58) Field of Search ..... 108/51.11, 902, 108/901, 53.1, 53.3, 55.1, 55.3, 57.29, 56.1, 56.3, 57.14, 57.25; 248/346.02; 206/386, 595, 596, 598, 599, 600

(56) References Cited

U.S. PATENT DOCUMENTS 1,770,614 A * 7/1930 Hennessy ..... 108/57.25
3,294,040 A 12/1966 Gregoire
3,580,190 A * 5/1971 Fowler ..... 108/57.25
3,699,901 A 10/1972 Cook, III
3,799,382 A * 3/1974 Munroe ..... 217/12 R
3,855,945 A 12/1974 Sebilleau et al.
3,954,067 A 5/1976 Miles
4,283,890 A * 8/1981 Takeda et al. ..... 52/143
5,052,307 A 10/1991 Morrison
5,211,117 A * 5/1993 Beamer ..... 108/57.17
5,226,621 A * 7/1993 Skoff ..... 248/97
5,483,899 A 1/1996 Christie
5,497,709 A 3/1996 Gonzalez et al.
5,527,585 A 6/1996 Needham et al.
5,687,653 A * 11/1997 Bumgarner ..... 108/57.19
D404,179 S 1/1999 Apps et al.
D404,180 S 1/1999 Apps et al.
6,029,583 A 2/2000 LeTrudet
6,095,292 A * 8/2000 Buck ..... 108/57.14
6,109,190 A 8/2000 Hale et al.
6,155,181 A * 12/2000 Chilcutt ..... 108/51.3
6,662,732 B2 * 12/2003 Birsel et al. ..... 108/25
6,705,237 B2 * 3/2004 Moore et al. ..... 108/57.25

* cited by examiner

*Primary Examiner*—Janet M. Wilkens
(74) *Attorney, Agent, or Firm*—Thomas C. Saitta

(57) ABSTRACT

A pallet composed of a removable plastic deck and a metal base, where the deck is joined to the base by mechanical interlocking, the deck having depending lugs which interlock with apertures in the upper surface of the base. Preferably, the lugs have sufficient depth and are correspondingly located to receive the legs of a superior pallet in a nesting manner.

28 Claims, 5 Drawing Sheets

METAL AND PLASTIC PALLET ASSEMBLY

BACKGROUND OF THE INVENTION

This invention relates generally to the field of pallets used to support loads or objects for storage or transport, and more particularly to such pallets which are provided with legs, skids or other support members to raise the deck member a short distance above the floor so that forklift equipment can be utilized to move the pallets. More particularly, the invention relates to such pallets which are composed of multiple component members, such that the deck member is separable from the base member.

Pallets are well known in the transportation and storage fields, and generally comprise either double deck members or support surfaces with interior separation brace members to provide the necessary openings for the forklift forks, or comprise a single deck member supported by legs or skids. Pallets must be of sufficient strength to support relatively heavy loads, and are typically composed of wood, plastic or metal, with wooden pallets being the most common due to manufacturing and material cost considerations, although the cost of such material is increasing as natural resources become increasingly scarce. Metal pallets are typically too expensive and too heavy for most applications, although they are by far the most durable. In addition, metal pallets having upper surfaces composed of grids or grates are unsuitable for soft goods or goods having soft cardboard packaging, since the weight of the goods results in undesirable surface indentations. Plastic pallets are inexpensive in terms of material and manufacturing cost, but lack the durability of wood or metal pallets. Wood and plastic pallets have limited work lives, since the rough handling inherent in moving the pallets results in frequent damage, necessitating repair or replacement. The damage most often occurs to the lower elements of the pallet—the legs, skids or support members which are contacted by the forklift forks.

To address the durability problem, pallets of improved structure and construction have been developed utilizing components of differing material composition or modular designs. Examples of such pallets include U.S. Pat. No. 3,699,901, issued in 1972 to Cook, U.S. Pat. No. 5,052,307, issued in 1991 to Morrison, U.S. Pat. No. 5,483,899, issued in 1996 to Christie, and U.S. Pat. No. 6,029,583, issued in 2000 to LeTrudet. More distantly related pallets along this same line include U.S. Pat. No. 3,294,040, issued in 1966 to Gregoire, U.S. Pat. No. 3,855,945, issued in 1974 to Sebilleau et al., U.S. Pat. No. 3,954,067, issued in 1976 to Miles, U.S. Pat. No. 6,109,190, issued in 2000 to Hale et al., U.S. Pat. No. 5,497,709, issued in 1996 to Gonzalez et al., and U.S. Pat. No. 5,527,585, issued in 1996 to Needham et al.

It is an object of this invention to provide a pallet assembly which more successfully addresses the durability problems inherent in the known pallet structures, where this object is accomplished by providing a base member composed of metal in combination with a removable deck member composed of plastic, thereby providing a base member of highest durability in combination with an easily interchangeable deck member of low cost, such that the overall useful life of the pallet assembly is maximized and further such that deck members of varying configuration, shape and structure may be utilized with a common base member. It is a further object to provide such a pallet assembly where the plastic deck member is connected to the metal base member using mating interlocking means integral to the metal base member and plastic deck member, such that separate mechanical fasteners are not required. It is a further object to provide such a pallet assembly where the plastic deck member may provide a flat support surface or a contoured or three-dimensional support surface defining a cavity to receive the object or objects. It is a further object to provide such a pallet assembly where the mating interlocking means are disposed interior to the perimeter or outer edge of the deck member and base member, and further where the mating interlocking means are structured to allow for nesting of the legs of a superior pallet disposed on an inferior pallet. It is a further object to provide such a pallet assembly where brace insert members may be secured within the mating interlocking means to extend above the deck member to secure objects on the pallet. Support for these objects will be found in the following disclosure. Furthermore, additional objects not expressly set forth above will become apparent based on the following disclosure.

SUMMARY OF THE INVENTION

The invention is a metal and plastic pallet assembly comprising in general a plastic deck member joined to a metal base member, where the metal base member provides the structural support for the pallet assembly and where the plastic deck member provides the direct support surface for the load or objects to be carried by the pallet. The plastic deck member is readily removable from the metal base member such that either the metal base member or the plastic deck member can be replaced if damaged, or such that the plastic deck member can be interchanged with a plastic deck member of different configuration while utilizing the same metal base member. The plastic deck member may present a generally flat load-receiving surface or may be contoured three-dimensionally to define an object-receiving tray or cavity. The metal base member may be provided with leg members, skid members or like structural elements to raise the plastic deck member above the floor to allow for insertion of forklift forks.

The removable plastic deck member is joined to the metal base member utilizing mating interlocking means which are formed as integral components of the metal base member and the plastic deck member, such that extraneous mechanical fasteners or the like are not required. The mating interlocking means allows for a press-fit or force-fit joining mechanism, such that the plastic deck member is in effect snapped onto the metal base member. Preferably, the integral mating interlocking means comprise a plurality of apertures disposed in the upper surface of the metal base member and resiliently deformable lug members depending from the plastic deck member, where the depending lug members are positioned and sized to correspond to the apertures in the metal base member. The apertures in the metal deck member are preferably formed by spaced structural members which define the upper surface of the metal base member, and the structural members are preferably rods or flat bars set to form a grid. In a preferred embodiment, the depending lug members comprise one or more shoulders or tabs positioned below and abutting the structural members of the metal base member to secure the plastic deck member to the metal base member. In a most preferred embodiment, the shoulders or tabs are paired and face toward each other, such that the rods or flat bars are disposed interior to the pair. With this construction, the tendency of the plastic deck member to shrink upon curing serves to provide a tighter fit.

In another preferred embodiment, the depending lug members of the plastic deck member are open on the top and have open interiors, and the metal base member is provided with leg members which are positioned at the same location as the depending lug members. This allows multiple pallets to be vertically stacked in a nesting manner, such that the leg members of superior pallets rest within the depending lug members of inferior pallets. Additionally, separable brace insert or strut members which extend above the plastic deck member to support objects may be provided, where the brace insert members are inserted into the open interiors of the depending lug members. The brace insert members are preferably provided with connection means to secure them to the depending lug members of the plastic upper deck, such as deformable detent members which correspond to the detent members of the depending lug members.

DETAILED DESCRIPTION OF THE INVENTION

With reference to the drawings, the invention will now be described in detail with regard for the best mode and the preferred embodiments. In a most general sense, the invention is a pallet assembly, defined to be a pallet for supporting loads or objects for storage or transport, of the type movable by a forklift or similar piece of equipment, where the pallet comprises a metal base member and a plastic deck member which is removably joined to the metal base member using mating interlocking means which are integral to the metal base member and the plastic deck member, such that separate or additional fastener means, such as mechanical fastener means or the like, are not required. The term deck member as used herein shall be taken to include the load-contacting member of the pallet, which may have a generally flat upper surface or which may be contoured or formed three-dimensionally to create a tray or one or more cavities to receive objects of particular shape. The term base member as used herein shall be taken to include the load bearing structural components necessary to support the load and the deck member.

Figure 1:
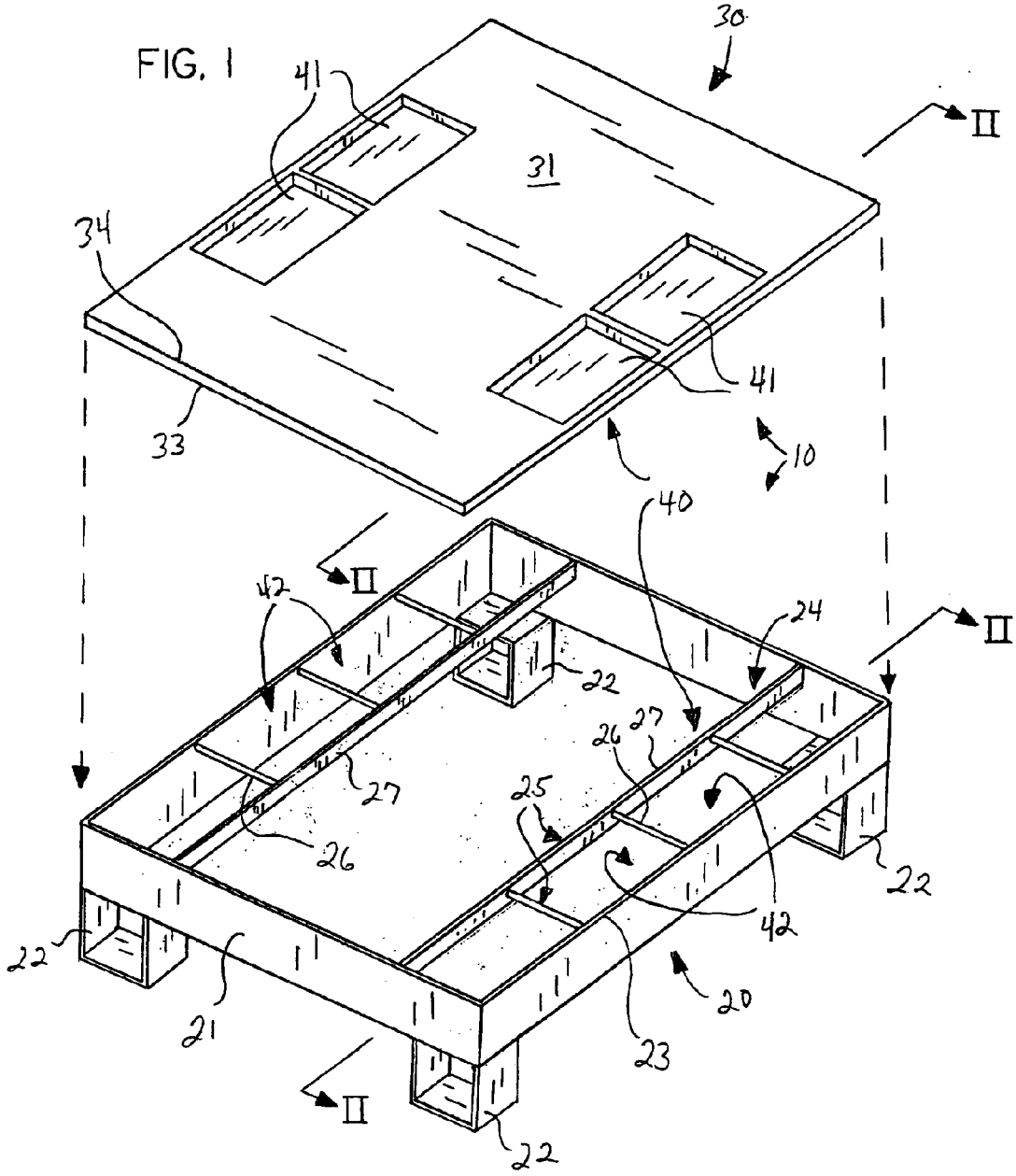
FIG. 1 is an exploded perspective view of the invention.
Figure 2:
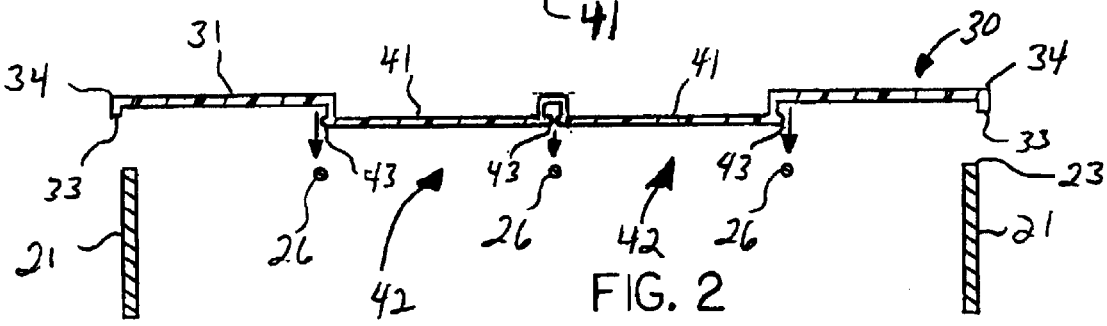
FIG. 2 is a cross-sectional view of the invention taken along line II—II of FIG. 1.
Figure 3:
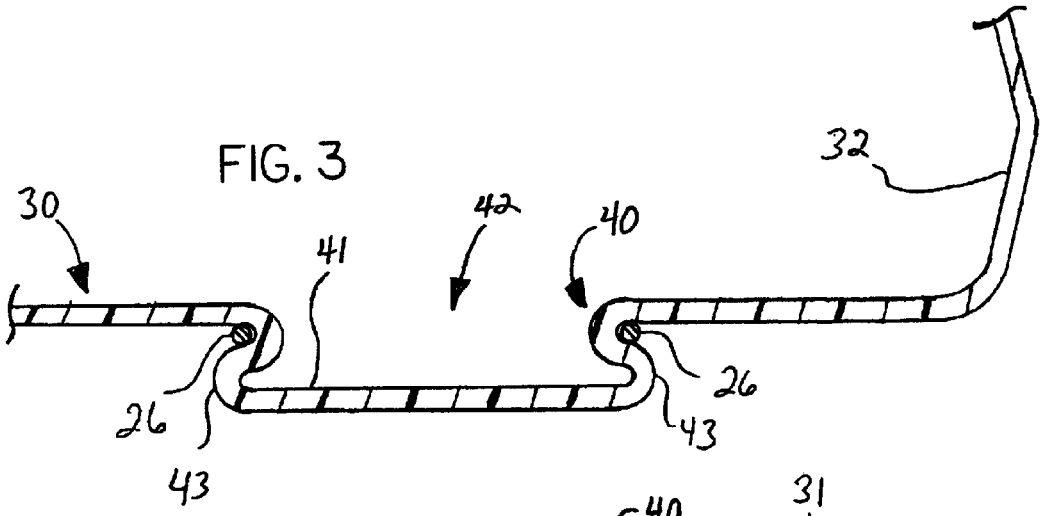
FIG. 3 is a partial cross-sectional view showing one embodiment of the mating interlocking means, where the depending lug member interlocks with rods.
Figure 10:
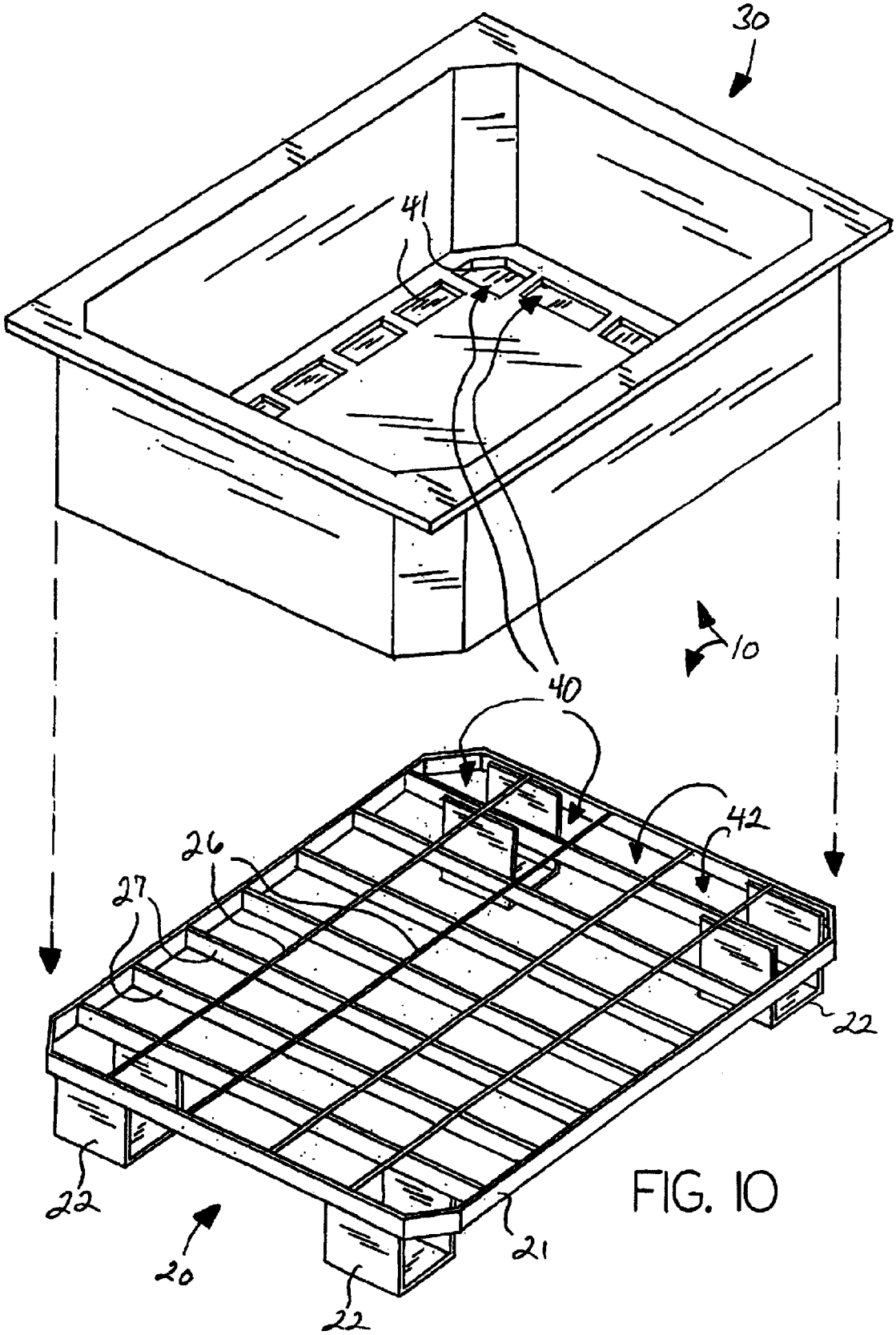
FIG. 10 is an exploded perspective view of an alternative embodiment of the invention, showing a deep deck member.

As shown in FIG. 1, the invention is a pallet assembly 10 comprising in general a metal base member 20 and a plastic deck member 30. The metal base member 10 and other metal components may be composed of any suitable metal having acceptable strength and durability properties for use in typical pallet applications, such as steel or aluminum for example. The plastic deck member 30 and other plastic components may be composed of any suitable plastic having acceptable strength and durability properties for use in typical pallet applications, such as polyethylene or ABS plastic for example. The plastic deck member 30 rests on top of the metal base member 20. The surface of the plastic deck member 30 which contacts the load or objects to be carried by the pallet 10 may comprise a generally flat load-receiving surface 31, as shown in FIGS. 1 and 2, or may alternately comprise a contoured, three-dimensional product-receiving tray or cavity 32, as shown in FIGS. 3 and 10, where the cavity 32 is configured as required to secure an object of particular shape. The plastic deck member 30 may be provided with edge members 33 about its outer perimeter 34, where the edge members 33 contribute to securing the plastic deck member 30 to the metal base member 20, as shown in FIG. 2, but it is most preferred that the perimeter 34 of the plastic deck member 30 not extend beyond the outer perimeter of the metal base member 20 to prevent the perimeter 34 of the plastic deck member 30 from catching on shelves, the forks of the forklift or other objects which might cause undesired separation of the plastic deck member 30 from the metal base member 20.

The metal base member 20 comprises a support frame member 21 to which are attached leg members 22, as shown, or alternatively skid, rails or other known structural components for providing access space beneath the pallet 10 for entry of the forks of forklift equipment. A simple construction comprising a generally rectangular frame member 21 with rectangular leg members 22 is shown, but it is to be understood that the structure of the metal base member 20 may vary greatly within the parameters necessary to provide sufficient strength and load bearing characteristics for the pallet 10. The frame member 21 defines an outer perimeter 23 which corresponds in dimension generally to the outer perimeter 34 of the plastic deck member, and further defines a generally flat upper surface 24 which directly supports the plastic deck member 30. In a most preferred construction, the upper surface 24 comprises spaced structural members 25 joined in an intersecting and preferably perpendicular manner to form a grid or grate. The structural members 25 may extend over only part of the upper surface 24, as shown in FIG. 1, or may be coextensive with the entire upper surface 25, as shown in FIG. 10. The structural members 25 may be composed of rod members 26 or flat bar members 27, and most preferably comprise a combination of both rods 26 and flat bars 27.

The plastic deck member 30 is removably connected to the metal base member 20 by integral mating interlocking means 40, where the mating interlocking means 40 consist of components formed as part of or comprising the plastic deck member 30 and the metal base member 20 which act in combination to secure the deck member 30 and base member 20, such that additional or extraneous fastening means, such as mechanical fasteners, e.g., threaded bolts and nuts, screws, clamps, etc., or other additional fastening means, such as straps, adhesives, etc., are not required to secure the plastic deck member 30 to the metal base member 20 in a manner which enables the plastic deck member 30 to be removed from the metal base member in a relatively simple operation, such that either the deck member 30 or the base member 20 may be replaced if damaged, or such that a deck member 30 of one configuration can be exchanged for a deck member 30 of another configuration. The integral mating interlocking means 40 allows the plastic deck member 30 to be securely joined to the metal base member in a force-fit, press-fit, snap-fit or like manner, where a component of the mating interlocking means 40 is deformable in some manner such that it is displaced or biased from its normal position during the joining operation but resumes its normal position when the deck member 30 and base member 20 are abutted in the operational relationship in order to temporarily secure the deck member 30 to the base member 20. Removal of the deck member 30 from the base member 20 is accomplished by displacing or biasing this component such that the deck member 30 and base member 20 can be separated.

Figure 11:
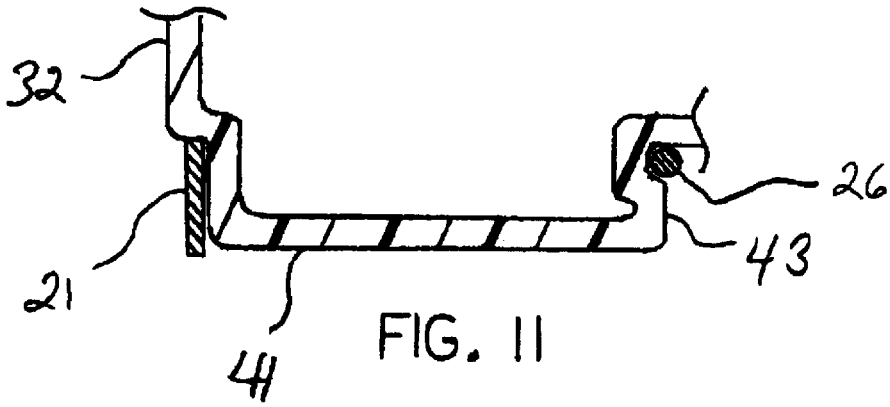
FIG. 11 is a partial cross-sectional view showing one half of a pair of an alternative embodiment of the mating interlocking means, where the depending lug member ha a detent member facing toward the detent member of the opposing depending lug member.

The mating interlocking means 40 are most preferably located within the interior of the deck member perimeter 34 and the base member perimeter 23, such that there is less likelihood of accidental separation of the deck member 30 from the base member 20 during movement of the pallet 10. The mating interlocking means 40 preferably comprise at least one and preferably more than one depending lug members 41 extending from said plastic deck member 30 and a corresponding number of lug-receiving apertures or recesses 42 positioned in the upper surface 24 of the metal base member 20, as shown in FIGS. 1 and 2. The lug members 41 are formed as an integral component of the plastic deck member 20 through well known plastic manufacturing techniques, extending a sufficient distance below the deck member surface 31 in order to interlock with the lug-receiving apertures 42. The lug-receiving apertures 42 in the metal base member 20 are formed by the spaced structural members 25, which in FIGS. 1 through 3 comprise rod members 26. The lug members 41 and lug-receiving apertures 42 are preferably generally rectangular in configuration for ease of manufacture, but other configurations are possible. The lug members 41 comprise at least one and preferably two detent tab or shoulder members 43 which physically interlock with the structural members 25 defining the lug-receiving apertures 42. In a most preferred embodiment, the detent members 43 are paired in opposing, inwardly-facing manner on two lug members 31, as shown partially in FIG. 11. Most preferably, the lug members 41 are slightly deformable in a resilient manner, such that detent members 43 are shifted or biased from the passive position during insertion of the lug members 41 into the lug-receiving apertures 42, but resume the passive position once the lug members 41 are fully inserted, such that the detent members 43 mate and interlock to prevent separation of the deck member 30 from the base member 20. The width of the lug member 41 in the direction containing the detent member 43 is greater than the corresponding width of the lug-receiving aperture 42. To remove the deck member 30 from the base member 20, the lug members 41 are biased to shift the detent members 43 from the passive position so that the lug members 41 are removable from the lug-receiving apertures 42.

Figure 6:
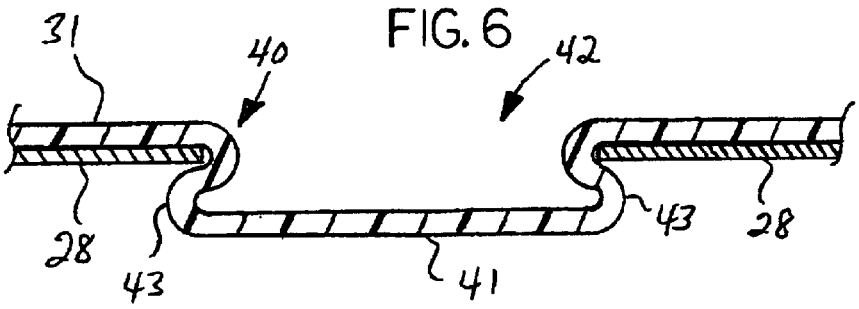
FIG. 6 is a partial cross-sectional view showing an alternative embodiment of the mating interlocking means, where the depending lug member interlocks with a flat plate member.
Figure 4:
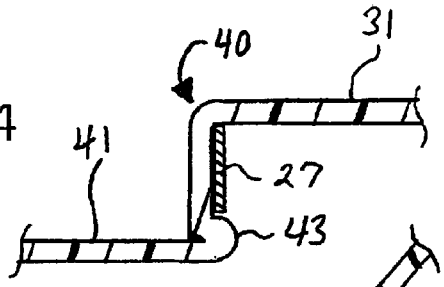
FIG. 4 is a partial cross-sectional view showing an alternative embodiment of the mating interlocking means, where the depending lug member interlocks with flat bars.
Figure 5:
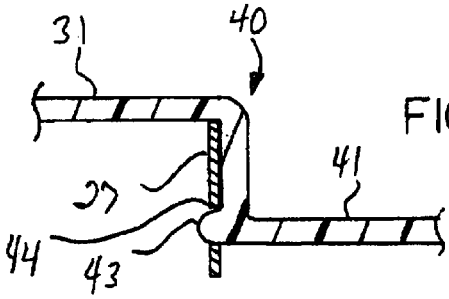
FIG. 5 is a partial cross-sectional view showing an alternative embodiment of the mating interlocking means, where the depending lug member interlocks with slots in the flat bars.

Alternative embodiments for the mating interlocking means 40 are shown in various drawings. In FIG. 3, the mating interlocking means 40 comprise a lug-receiving aperture 42 formed by opposing pairs of rod members 26, where an opposing pair of detent members 43 interlock with the rod members 26. In FIG. 4, the lug-receiving aperture 42 is formed from flat bar members 27, and the lug members are deeper to properly position the detent member 43. In FIG. 5, the flat bar member 27 is provided with a slot 44 to receive the detent member 43 of the lug member 41. In FIG. 6, the upper surface 24 of the metal base member 20 is formed by a flat plate member 28, with the lug-receiving aperture 42 being defined by an opening in the flat plate member 28 such that the detent member 43 abuts the underside of the flat plate member 28.

Figure 7:
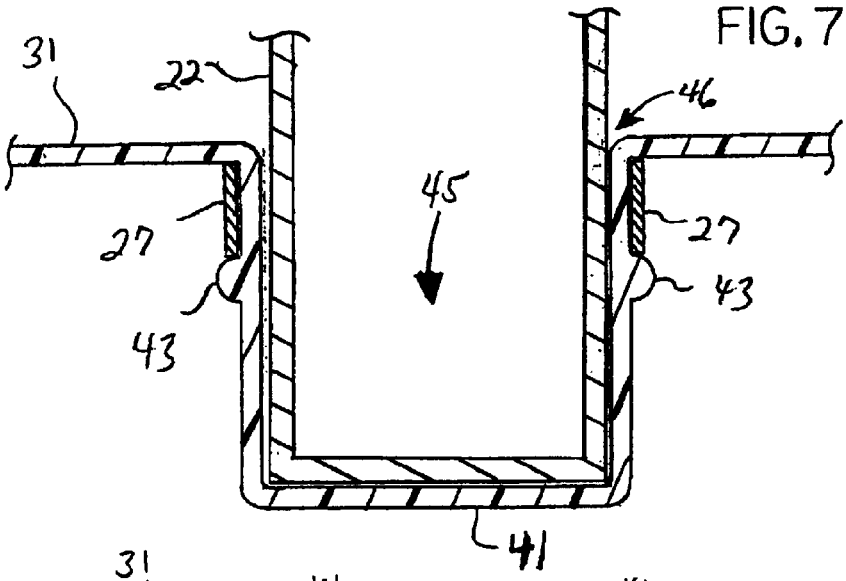
FIG. 7 is a partial cross-sectional view showing an alternative embodiment of the mating interlocking means, where the depending lug member is constructed to receive a leg member of a superior pallet in a nesting manner.
Figure 9:
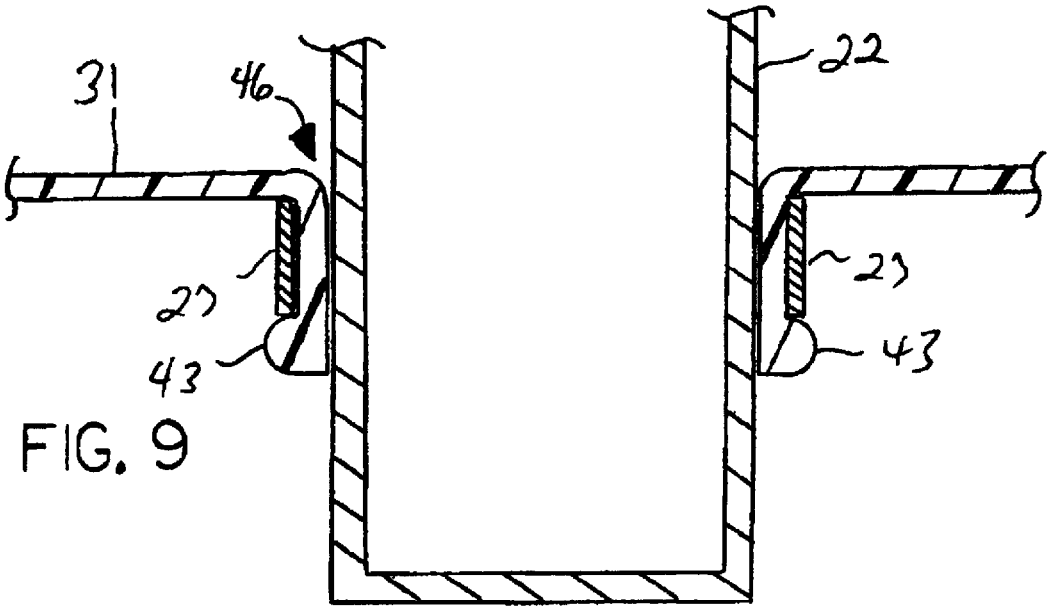
FIG. 9 is a partial cross-sectional view showing a leg member of a superior pallet nesting in a lug member having an open bottom.

A more preferred embodiment for the pallet assembly 10 is shown in FIG. 7, where the structure of the mating interlocking means 40 enables multiple pallets 10 to be stacked vertically in a nested manner such that the stack of pallets 10 is of reduced height. In this embodiment the depending lug member 41 of the plastic deck member 30 is lengthened beyond that necessary to interlock with the lug-receiving aperture 42, thereby defining an open interior 45 and a leg-receiving top opening 46. By providing this depth, and by positioning the mating interlocking means 40 directly above the leg members 22 of the metal base 20, the leg members 22 of a superior or upper pallet 10 will be received within the lug members 41 of an inferior or lower pallet 10, such that the leg members 22 will pass through the leg-receiving openings 46 and rest in the open interiors 45 of the lug members 41. Alternatively, the bottoms of the lug members 41 could be removed to create an opening through which the leg members 22 can extend, as shown in FIG. 9.

Figure 8:
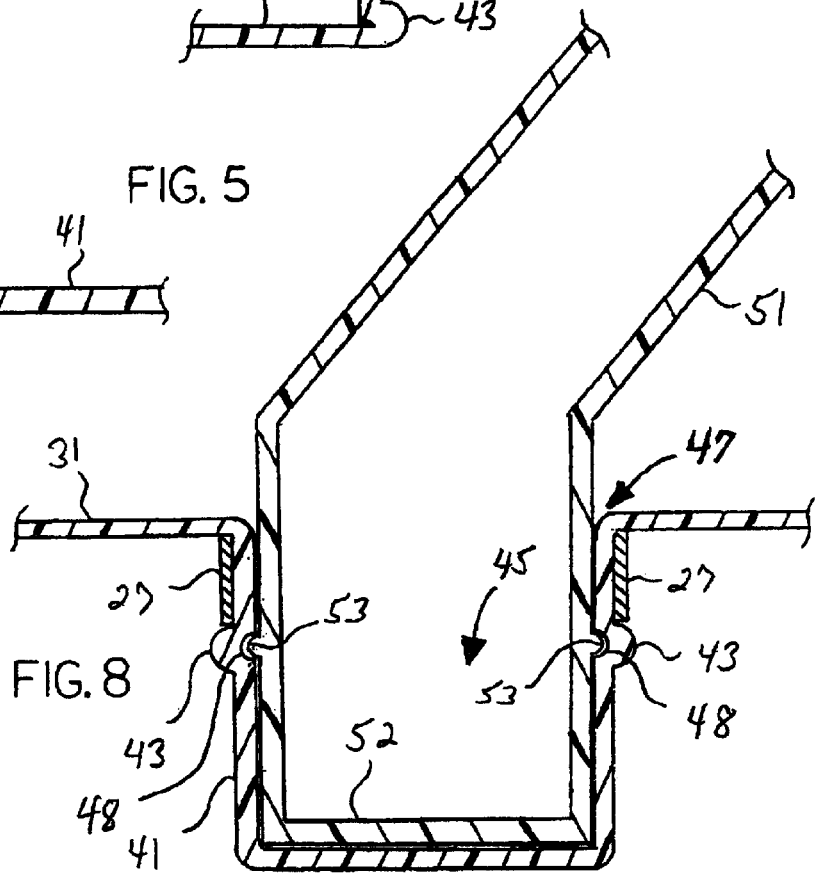
FIG. 8 is a partial cross-sectional view showing a brace insert member received by a depending lug member.

The provision of lug members 41 of extended depth or with open bottoms enables brace insert or strut members 51 to be incorporated into the pallet assembly 10, as shown in FIG. 8 without the necessity of providing additional receptacles in the plastic deck member 30 for the brace inserts 51. The brace insert members 51 are configured with an insertion end 52 which generally corresponds to the open interior 45 of the lug member 41, with the open top in this instance being defined as a brace insert receiving opening 47. Preferably, the brace insert insertion end 52 is provided with detent members 53, such as shoulders or tabs, which correspond to and mechanically interlock with detent receptacles 48 in said lug members 41, in order to more securely join the brace insert members 51 to the deck member 30.

It is contemplated that equivalents and substitutions to certain elements set forth above may be obvious to those skilled in the art, and therefore the true scope and definition of the invention is to be as set forth in the following claims.

I claim:

1. A pallet assembly comprising a metal base member and a removable plastic deck member joined to said metal base member, and integral mating interlocking means which in combination join said plastic deck member to said metal base member;

wherein said metal base member and said plastic deck member each comprise an outer perimeter, wherein said mating interlocking means are positioned within said outer perimeters of said metal base member and said plastic deck member;

wherein said metal base member further comprises a generally flat upper surface and wherein said mating interlocking means comprises apertures disposed in said upper surface of said metal base member and depending lug members on said plastic deck member which extend through said apertures in said metal base member upper surface; and wherein said depending lug members each comprise at least one detent member, wherein the width of said depending lug members in a direction containing said at least one detent member is greater than the corresponding width of said apertures in said upper surface of said metal base member in such direction.

2. The pallet assembly of claim 1, wherein said metal base member upper surface comprises a plurality of spaced structural members.

3. The pallet assembly of claim 2, wherein said spaced structural members comprise rods joined to define a grid.

4. The pallet assembly claim 3, wherein said spaced structural members further comprise flat bars, wherein said rods are disposed parallel to each other and said flat bars are disposed parallel to each other, with said rods disposed perpendicularly to aid flat bars.

5. The pallet assembly of claim 4, wherein said flat bars adjacent said apertures are provided with slots to receive said at least one detent member of said depending lug members.

6. The pallet assembly of claim 1, wherein said metal base member comprises at least four depending leg members located directly below at least four of said apertures in said upper surface of said metal base member, and wherein aid depending lug members corresponding to said at least four of said apertures each comprise open interior and a leg receiving opening, such that the pallet assembly is nestable when vertically stacked with another such pallet assembly.

7. The pallet assembly of claim 1, wherein said plastic deck member comprises a generally flat load receiving surface.

8. The pallet assembly of claim 1, wherein said plastic deck member comprises a product receiving cavity.

9. The pallet assembly of claim 1, further comprising removable brace insert members for securing objects on said plastic deck member, wherein said depending lug members comprise an open interior and a brace insert receiving opening, such that said brace insert members can be secured in said open interior of said depending lug members.

10. The pallet assembly of claim 9, wherein said brace insert members comprise detent members which mechanically interlock with said depending lug members of said plastic deck member.

11. A pallet assembly comprising a metal base member and a removable plastic deck member joined to said metal base member by integral mating interlocking means, wherein said metal base member further comprises a generally flat upper surface and wherein said mating interlocking means comprises apertures disposed in said upper surface of said metal base member and depending lug members on said plastic deck member which extend through said apertures in said metal base member upper surface; and wherein said depending lug members each comprise at least one deter member, wherein the width of said depending lug members in a direction containing said at least one detent member is treater than the corresponding width of said apertures in said upper surface of said metal base member in such direction.

12. The pallet assembly of claim 11, wherein said metal base member upper surface comprises a plurality of spaced structural members.

13. The pallet assembly of claim 12, wherein said spaced structural members comprise rods joined to define a grid.

14. The pallet assembly of claim 13, wherein said spaced structural members further comprise flat bars, wherein said rods are disposed parallel to each other and said flat bars are disposed parallel to each other, with said rods disposed perpendicularly to said flat bars.

15. The pallet assembly of claim 14, wherein said flat bars adjacent said apertures are provided with slots to receive said at least one detent member of said depending lug members.

16. The pallet assembly of claim 15, wherein said metal base member comprises at least four depending leg members located directly below at least four of said apertures in said upper surface of said metal base member, and wherein said depending lug members corresponding to said at least four of said apertures each comprise open interior and a leg receiving opening, such that the pallet assembly is nestable when vertically stacked with another such pallet assembly.

17. The pallet assembly of claim 15, wherein said plastic deck member composes a generally flat load receiving surface.

18. The pallet assembly of claim 15, wherein said plastic deck member comprises a product receiving cavity.

19. The pallet assembly of claim 11, further comprising removable brace insert members for securing objects on said plastic deck member, wherein said depending lug members comprise an open interior and a brace insert receiving opening, such that said brace insert members can be secured in said open interior of said depending lug members.

20. The pallet assembly of claim 19, wherein said brace insert members comprise detent members which mechanically interlock with said depending lug members of said plastic deck member.

21. A pallet assembly comprising a metal base member and a removable plastic deck member joined to said metal base member by integral mating interlocking means, wherein said metal base member further comprises a generally flat upper surface and wherein said mating interlocking means comprises apertures disposed in said upper surface of said metal base member and depending lug members on said plastic deck member which extend through said apertures in said metal base member upper surface, wherein said metal base member upper surface comprises a plurality of spaced structural members, wherein said depending lug members each comprise at least one detent member, wherein the width of said depending lug members in a direction containing said at least one detent member is greater than the corresponding width of said apertures in said upper surface of said metal base member in such direction.

22. The pallet assembly of claim 21, wherein said spaced structural members comprise rods joined to define a grid.

23. The pallet assembly of claim 22, wherein said spaced structural members further comprise flat bars, wherein said rods are disposed parallel to each other and said flat bars are disposed parallel to each other, with said rods disposed perpendicularly to said flat bars.

24. The pallet assembly of claim 21, wherein said metal base member comprises at least four depending leg members located directly below at least four of said apertures in said upper surface of said metal base member, and wherein said depending lug members corresponding to said at least four of said apertures each comprise open interior and a leg receiving opening, such that the pallet assembly is nestable when vertically stacked with another such pallet assembly.

25. The pallet assembly of claim 21, wherein said plastic deck member comprises a generally flat load receiving surface.

26. The pallet assembly of claim 21, wherein said plastic deck member comprises a product receiving cavity.

27. The pallet assembly of claim 21, further comprising removable brace insert members for securing objects on said plastic deck member, wherein said depending lug members comprise an open interior and a brace insert receiving opening, such that said brace insert members can be secured in said open interior of said depending lug members.

28. The pallet assembly of claim 27, wherein said brace insert members comprise detent members which mechanically interlock with said depending lug members of said plastic deck member.

* * * * *